United States Patent [19]

Clark et al.

[11] Patent Number: 4,468,532

[45] Date of Patent: Aug. 28, 1984

[54] PNEUMATIC REED SWITCH

[75] Inventors: Paul M. Clark, Middletown; Danny L. Fenwick, Springdale, both of Ohio; Jon D. Hopkins, Unionville, Conn.

[73] Assignee: General Electric Company, Cincinnati, Ohio

[21] Appl. No.: 443,827

[22] Filed: Nov. 22, 1982

[51] Int. Cl.[3] ..... H01H 35/24; H01H 35/40

[52] U.S. Cl. ..... 200/81.9 R; 200/61.51; 200/81 R

[58] Field of Search ..... 200/81 R, 81.9 R, DIG. 5, 200/67 D, 67 DA, 243, 246, 61.51, 61.52

[56] References Cited

U.S. PATENT DOCUMENTS

| | | | |
|---|---|---|---|
| 1,205,530 | 11/1916 | Hall | 200/81.9 R |
| 1,561,813 | 11/1925 | Williams | 200/81.9 R |
| 2,503,581 | 3/1947 | French | 200/81.9 R |
| 3,226,505 | 12/1965 | Lucas | 200/81.9 R |

FOREIGN PATENT DOCUMENTS

| | | | |
|---|---|---|---|
| 681825 | 9/1929 | France | 200/81.9 R |

*Primary Examiner*—Joseph W. Hartary
*Assistant Examiner*—M. Reinhart
*Attorney, Agent, or Firm*—Gregory A. Welte; Derek P. Lawrence

[57] ABSTRACT

An invention is disclosed wherein one portion of conductor is fastened to a housing and another portion is movable. Fluid pressure applied through a passage forces the movable portion into contact with electrical terminals.

9 Claims, 3 Drawing Figures

PNEUMATIC REED SWITCH

The invention relates to electrical switches and, more particularly, to switches of this type which utilize a reed conductor to complete a circuit between switching contacts.

BACKGROUND OF THE INVENTION

It is sometimes necessary to accomplish electrical switching in a remote, high temperature environment which is subject to high centrifugal forces. For example, in a gas turbine engine, temperatures can exceed 1000° F. and rotating components can experience centrifugal forces of the order of 10,000 g's. In such an environment, ordinary remote switching means, such as transistors and relays, are found to be inadequate. Further, space limitations inside such engines dictate that any switches contained therein be of minimal size.

OBJECTS OF THE INVENTION

It is an object of the present invention to provide a new and improved electrical switch.

It is a further object of the present invention to provide a new and improved remotely operated electrical switch which is tolerant of a high temperature environment.

It is a further object of the present invention to provide a new and improved electrical switch which is operable in a high centrifugal force field.

SUMMARY OF THE INVENTION

One form of the switch of the present invention comprises a plurality of terminals supported near a movable conductor. Fluid pressure selectively applied to the conductor through a passage forces the movable conductor into contact with the terminals.

DETAILED DESCRIPTION OF THE INVENTION

Figure 1:
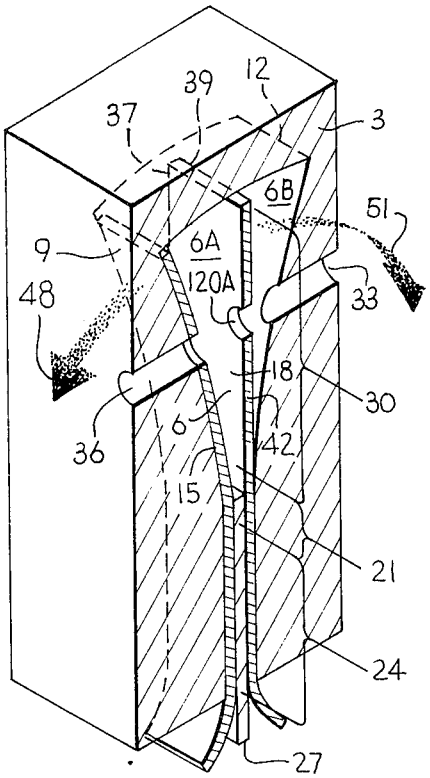
FIG. 1 is a cut-away view of one form of the present invention.

One form of the invention is shown in FIG. 1 wherein a housing 3 contains a V-shaped chamber 6. A first chamber wall 9 comprises a first leg of the "V" while a second chamber wall 12 comprises the second leg of the "V". A first electrical conductor 15 is extended along, and is fastened to, the first wall 9. This conductor is preferably a thin, elongated metallic foil, such as stainless steel or an alloy comprising nickel and chromium, and approximately 0.003 in. (0.0076 cm) thick. The foil may be plated with a low resistivity material such as gold. A second electrical conductor 18 is fastened to the apex of the "V", namely at region 21. Both conductors 15 and 18 extend away from the apex of the "V" through the housing, that is, through the region designated 24, and in this region are separated from each other by an electrical insulator 27 which is sandwiched between them. Insulator 27 may be constructed of a suitable high temperature material such as a glass, a ceramic, or asbestos.

The second conductor 18 extends into the chamber 6 and extends along or near the second chamber wall 12. The second conductor 18 is preferably elongated, in that it extends away from the apex region 21 and substantially along the length 30 of chamber 6. The second conductor 18 is further reed-like in that it is elongated, wide, thin (approximately 0.003 in. [0.0076 cm] thick), and flexible. The housing 3 contains an inlet air passage 33 which communicates with the chamber 6 through the second chamber wall 12. The housing 3 further contains an exhaust air passage 36 which communicates with the chamber by penetrating the first chamber wall 9 as well as the first conductor 15. The wide side, namely the side facing the first conductor 15, of the second conductor 18 is preferably of a shape identical to the second wall 12 but slightly smaller in size so that there is a clearance of, for example, 0.001 in. between itself and the housing 3 along edges 37, 39 and 42. Edges 37, 39, and 42 are more clearly shown in FIG. 3 and the clearance is indicated as spaces 37A, 39A, and 42A.

Being flexible, the second conductor 18 can be moved in the directions of arrows 48 and 51, but its natural tendency is to remain out of contact with the first conductor 15 either through the inherent resiliency of the second conductor 18 or through the centrifugal loading applied to it as explained below.

The operation of the switch of FIG. 1 in the absence of centrifugal loading is as follows. Second conductor 18 serves to divide chamber 6 into two sub-chambers, namely 6A and 6B. A pressurized fluid such as air is applied to the inlet air passage 33, tending to expand sub-chamber 6B and to apply a force to the second conductor 18 in the direction of arrow 48 thereby moving the second conductor into contact with the first conductor 15. In so moving, the second conductor 18 reduces the size of sub-chamber 6B and the air which must be displaced by this reduction is exhausted through exhaust passage 36. If the air pressure is removed from inlet passage 33, the resiliency of the second conductor 18 (and, again, possibly centrifugal force) will cause it to move in the direction of arrow 51 thereby displacing air contained in the sub-chamber 6B through the inlet passage 33. Of course, this latter motion may be assisted by the application of air pressure to exhaust passage 36.

Figure 2:
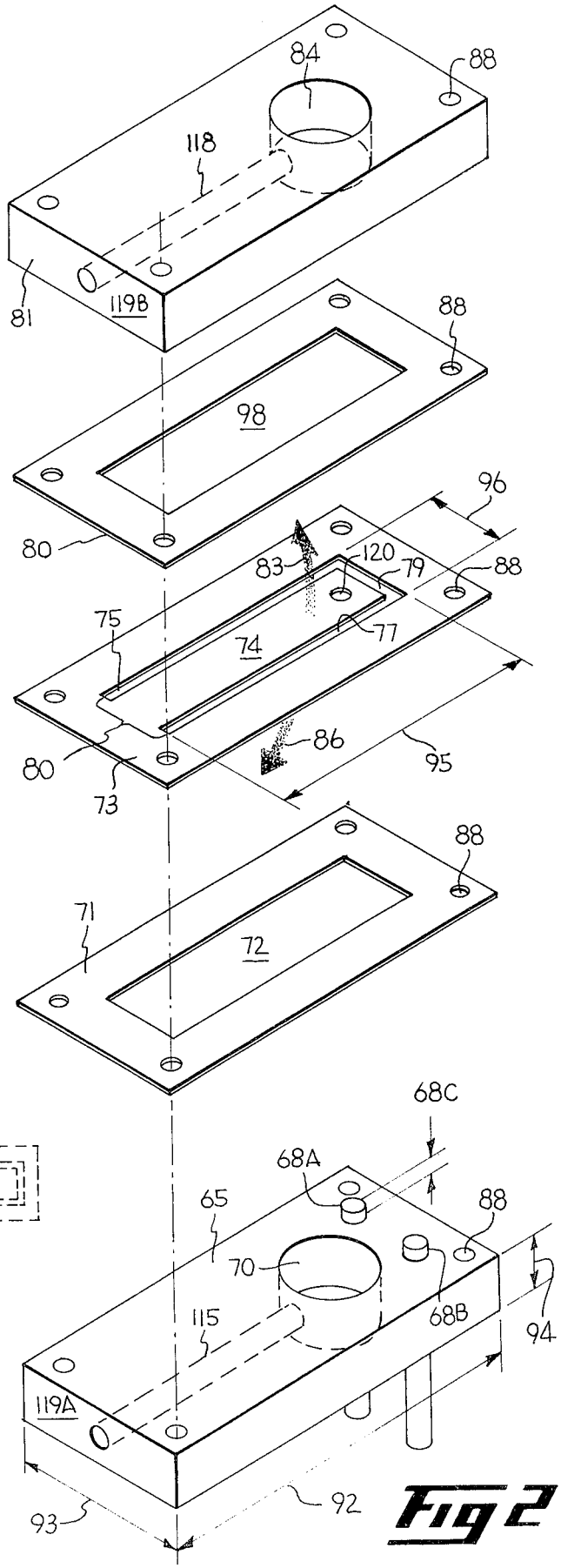
FIG. 2 is an exploded view of another form of the present invention.

A second embodiment of the invention is shown in exploded form in FIG. 2. In that Figure, a rectangular first base 65, which is preferably a solid, heat-resistant ceramic such as sapphire or aluminum oxide sputtered to a stainless steel substrate is penetrated by and supports a pair of rod-like electrical terminals or contacts 68A–B. An exhaust passage 70 extends through the first base 65. A thin first rectangular layer or lamina 71, having a rectangular hole 72 cut in the center thereof is supported by the base 65. The rectangular hole 72 must be wide enough to allow the terminals 68A–B to pass therethrough so that the first rectangular layer can contact the first base 65.

A thin second rectangular layer 73 is positioned adjacent the first rectangular layer 71. The second rectangular layer 73 includes a reed or contact member 74 which can be integrally formed into the second layer 73 by cutting parallel slits 75 and 77 through the second layer 73 and connecting them with a slit 79 to provide a thin, elongated contact member 74 supported at region 80. Since the second layer 73 is preferably composed of a thin material, the contact member 74 can be moved in the direction of arrows 83 and 86, that is, the contact member 74 is flexible and can pivot about the region of support 80 in the direction of arrows 83 and 86. It is to be noted that the distance 68C, namely the distance which the terminals 68A–B extend above the surface of the rectangular base 65, must be less than the thickness of the first rectangular layer 71. Otherwise, the contact member 74 will at all times be in contact with the terminals 68A–B, thereby completing the circuit across them at all times. However, it is envisioned that it may be desirable in some cases to construct a switch in which the contact member 74 normally is in contact with the terminal 68–B. In such a case, the contact member will be disconnected from the terminals 68A–B by air pressure applied to the exhaust passage 70.

A third rectangular layer 80, preferably identical in size and shape to the first layer 71, is positioned on top of the second layer 73. A second rectangular base 81, containing an inlet passage 84, lacking structures analogous to terminals 68A–B, but otherwise identical to rectangular base 65 is positioned atop the third rectangular layer 80. The entire structure described forms a five-layered sandwich which can be clamped together by suitable means such as passing bolts (not shown) through holes 88, by diffusion bonding or welding.

In a preferred form of the second embodiment, all of the rectangular components described have a length of 0.75 in. (1.95 cm) and a width of 0.375 in. (0.953 cm), which dimensions correspond to, respectively, dimensions 92 and 93. The two rectangular bases 65 and 81 are preferably 0.125 in. (0.318 cm) thick, which is the length of dimension 94. The three rectangular layers, namely 71, 73 and 80 in addition to having the lengths and widths just described, are preferably 0.004 inches thick and constructed of stainless steel. The reed or contact member 74 is preferably 0.5 in. (1.27 cm) long (dimension 95) and 0.125 in. (0.318 cm) wide (dimension 96). Reed 74 is preferably gold plated in the region near terminals 68A–B for better conductivity.

The operation of the second embodiment of FIG. 2 is as follows. When air pressure is applied to the inlet passage 84, the pressure transmits a force to the reed 74 tending to push it in the direction indicated by arrow 86 and the force pushes the reed 74 into contact with the terminals 68A–B. When contact is made between the reed 74 and terminals 68A–B the circuit is completed between these terminals. During this motion of reed 74, the space contained within the rectangle 72 in the first rectangular layer 71 is decreased in volume and the air therein which is displaced is exhausted through the exhaust passage 70. When the air pressure is removed from the inlet passage 84, the reed 74 will tend to return to its original position due to its inherent resiliency, thus displacing air from the space containing within rectangle 98 in the third rectangular layer 80. This air flows out through the inlet passage 84. Of course, the return of reed 74 to its original position may be assisted by the application of air pressure to the exhaust passage 70.

A third embodiment is contemplated in which the first and third rectangular layers are constructed of an insulating material such as asbestos and ony one of the terminals 68A–B is present. In this case, reed 74 itself serves as the other terminal.

Figure 3:
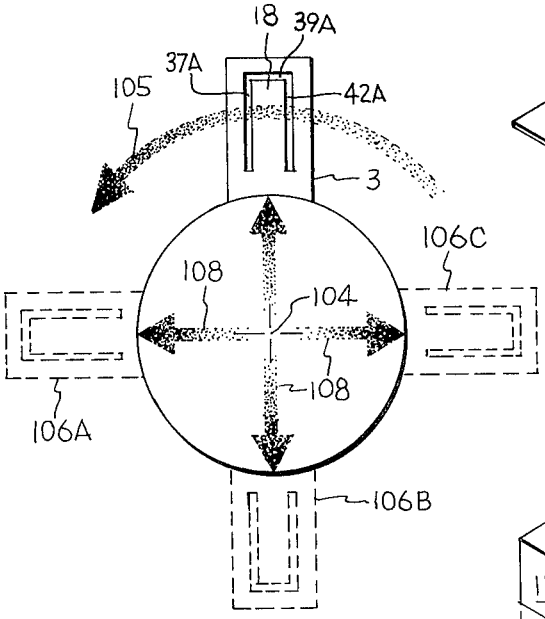
FIG. 3 illustrates rotational motion which one form of the present invention can experience.

The use of any of the above embodiments in a high centrifugal force field such as in a gas turbine engine will now be described. FIG. 3 shows an axis 104 about which the housing 3 of FIG. 1 is rotated in the direction of arrow 105. The successive positions of housing 3 are indicated by phantom outlines 106A–C. (It is to be noted that the flat, wide surfaces of reed 18 are parallel to, and spin in, a radial plane, namely the plane of FIG. 3. The reed 18 moves in a path, indicated by curved arrows 48 and 51, shown in FIG. 1, which path is actually arcuate, since the reed 18 pivots about apex at region 21 in FIG. 1. However, the component of motion of the reed 18 in the radial direction (that is, in a direction against the centrifugal force) is viewed as small because the deflection of the reed 18 from its original position is small. Thus, the motion of the reed 18 is viewed as being substantially parallel with the axis of rotation, that is, perpendicular to the plane of FIG. 3.

During this rotation the switch experiences a radially directed force, commonly called centrifugal force, in the direction of arrows 108. At high rotational speeds, the centrifugal force can be extremely large. For example, at 10,000 rpm, an object 6 in. (0.5 foot) away from the axis of rotation experiences a centrifugal acceleration of $5.8\times10^5$ feet/sec$^2$, which is approximately equivalent to 17,000 g's. Utilizing a switch under these conditions wherein a component is moved in a direction opposite to the centrifugal force, will require a similarly enormous force to move the component against the inhibiting centrifugal force.

However, in the case of the switches of the first and second embodiments of the present invention, the centrifugal force is seen as assisting and not inhibiting the switching operation. The switching reeds 18 and 74 of FIGS. 1 and 2 have been described as being 0.003 and 0.004 in. (0.0076 and 0.010 cm) thick, respectively. That is, the reeds 18 and 74 are constructed of thin metallic foil. They can be thought of as flimsy for that reason. However, in the environment of the large, radial centrifugal force field, the otherwise flimsy foil, which extends in the radial direction, becomes rigid due to centrifugal stiffening. Viewed another way, a relatively large amount of strength and resiliency is imparted to a very lightweight and relatively weak material during rotation. Accordingly, the tendency of the switching reed 18 to return to its original position upon release of the air pressure from inlet passage 33 is increased, yet without the addition of springs or mass to the reed which would otherwise be needed in a static, nonrotating situation. The operation of the second embodiment during rotation is similar to that just described for the first embodiment.

In a fourth embodiment of the invention, passages 115 and 118 (shown as dashed lines) are contained in rectangular bases 65 and 81 in FIG. 2, respectively, so that air pressure may be supplied to the passages 70 and 84, respectively, from the end surfaces 119A and 119B.

It has been found that the switching reed 18 or 74 sometimes flutters or vibrates during use. It is theorized that the vibration is caused by the blockage of the exhaust air passage 36 or 70 by the respective reed 18 or 74. Such a blockage reduces airflow through the exhaust passage and, it is thought, reduces the force applied to the reed, thus allowing the reed to return to its original position. One method of alleviating this problem has been to provide a hole such as hole 120 in the reed 74. The hole 120 allows continuity of some of the airflow through the exhaust passage 84. A similar hole 120A can be provided in the second conductor 18 in FIG. 1.

A related patent application entitled, "Pneumatic Ball Contact Switch," by Danny L. Fenwick and Jon D. Hopkins, Ser. No. 06/443,826, which is concurrently filed herewith and assigned to a common assignee, is hereby incorporated by reference. The fluid pressure applied to the present invention can be provided by the invention described in the patent application entitled, "Pneumatic Signal Multiplexer," by Danny L. Fenwick and Charles M. Stanforth, Ser. No. 06/443,825, which is concurrently filed herewith, assigned to a common assignee, and hereby incorporated by reference herein.

The switch of the present invention provides a remote electrical switching function which is tolerant to high temperatures and which can operate in a high centrifugal force field. Further, the centrifugal force field is utilized to provide a resiliency characteristic tending to push the switching member into a predetermined position and this characteristic is much greater than is obtained in the static case for the size and weight of the materials involved.

While several embodiments of the invention have been described, it will be obvious to those skilled in the art that numerous modifications and substitutions can be undertaken without departing from the true spirit and scope of the present invention.

Accordingly, what is desired to be secured by Letters Patent is the invention as defined in the following claims:

1. An electrical switch comprising:
(a) a housing containing a chamber;
(b) a conductive reed which divides the chamber into a plurality of expansible compartments;
(c) two electrical terminals contained in one of the compartments;
(d) a passage connecting with one of the compartments for introducing fluid into that compartment to change the size of that compartment to urge the reed into contact with both terminals; and
(e) a perforation in the reed for reducing flutter of the reed during the contact established in (d) by allowing fluid to pass through the reed.

2. An electrical switch comprising:
(a) a housing containing a chamber;
(b) a reed bearing a conductor and dividing the chamber into a plurality of expansible compartments;
(c) a plurality of electrical terminals contained in the chamber;
(d) passage connecting with one of the compartments for changing the size of that compartment when fluid pressure is applied to the passage to thereby move the reed bearing the conductor into contact with two of the terminals; and
(e) a perforation in the reed for reducing flutter of the reed during the contact established in (d) by allowing fluid to pass through the reed.

3. An electrical switch comprising:
(a) a housing containing a chamber; p1 (b) a pair of flat, elongated conductors, at least one of which is movable and resilient, and both of which are contained within the chamber, are fastened to the housing, are mutually insulated near the point of fastening, and are biased out of contact with each other;
(c) a passage in the housing for applying fluid pressure to the resilient conductor for bringing the two conductors into contact; and
(d) a perforation in the movable conductor for reducing flutter of the conductor during the contact established in (c) by allowing fluid to pass through the conductor.

4. A switch according to claim 3 in which a portion of the nonresilient conductor is immovably attached to the housing wall.

5. A switch according to claim 1, 2 or 3 in which the housing comprises stacked lamina in which adjacent perforations form the passage.

6. A switch according to claim 5 in which the lamina are diffused bonded together.

7. A method of electrical switching, comprising the steps of:
(a) rotating a conductive reed about an axis; and
(b) deflecting the reed substantially parallel to the axis and into contact with a plurality of terminals positioned near the reed for completing the circuit between at least some of the terminals.

8. A method according to claim 7 in which the rotation of step (a) is greater than 10,000 rpm, the reed comprises a metal, has one dimension less than 0.005 in. (0.013 cm) thick, and in which the deflection of step (b) is accomplished by application of fluid pressure to the reed.

9. An electrical switch for use on a component which rotates about an axis in a gas turbine engine, comprising:
(a) a chamber within a housing and having an apex region definable therein;
(b) an inlet fluid passage and an exhaust fluid passage both connecting to the chamber;
(c) a flat, wide, foil reed which
(i) is contained within the chamber,
(ii) is connected to the housing near the apex region, and
(iii) has a thickness of about 0.003 inches; wherein the foil reed can pivot about the apex region and move toward the exhaust passage upon the application of fluid pressure to the inlet passage;
(d) a perforation in the foil reed for maintaining flow through the reed and out through the exhaust passage when the foil reed is displaced toward the exhaust passage to thereby reduce flutter of the foil reed; and
(e) spinning means for rotating the switch about an axis such that
(i) at least part of the foil reed is subject to a centrifugal acceleration exceeding 5,000 g's which acceleration
A. stiffens the foil and biases the foil reed in a selected position and
B. the flat reed is biased to be parallel to a plane which is perpendicular to the axis of (e).

* * * * *

UNITED STATES PATENT AND TRADEMARK OFFICE

CERTIFICATE OF CORRECTION

PATENT NO. : 4,468,532

DATED : August 28, 1984

INVENTOR(S) : Paul M. Clark; Danny L. Fenwick; and Jon D. Hopkins

It is certified that error appears in the above-identified patent and that said Letters Patent is hereby corrected as shown below:

IN THE TITLE:

Pneumatic Reed Switch should read: -- Pneumatic Leaf Switch--

CLAIMS:

(Claim 3) Column 5, line 55, delete "p1".

Signed and Sealed this

*Sixteenth* Day of *July 1985*

[SEAL]

*Attest:*

DONALD J. QUIGG

*Attesting Officer* *Acting Commissioner of Patents and Trademarks*